US007850326B2

(12) United States Patent
Herper et al.

(10) Patent No.: US 7,850,326 B2
(45) Date of Patent: Dec. 14, 2010

(54) ILLUMINATION DEVICE FOR ITEMS OF FURNITURE

(75) Inventors: Markus Herper, Mühltal (DE); Tarek Utturkar, Ober-Ramstadt (DE); Martin Staude, Pfungstadt (DE)

(73) Assignee: Mepla-Werke Lautenschlager GmbH & Co. KG, Reinheim (DE)

( * ) Notice: Subject to any disclaimer, the term of this patent is extended or adjusted under 35 U.S.C. 154(b) by 211 days.

(21) Appl. No.: 12/067,490

(22) PCT Filed: Oct. 14, 2006

(86) PCT No.: PCT/EP2006/009935

§ 371 (c)(1),
(2), (4) Date: Mar. 20, 2008

(87) PCT Pub. No.: WO2007/048514

PCT Pub. Date: May 3, 2007

(65) Prior Publication Data

US 2008/0205045 A1 Aug. 28, 2008

(30) Foreign Application Priority Data

Oct. 27, 2005 (DE) ..... 20 2005 016 829 U

(51) Int. Cl.
*F21V 33/00* (2006.01)

(52) U.S. Cl. ..... 362/155; 362/127; 362/132; 362/133; 362/374; 362/375

(58) Field of Classification Search ..... 362/127, 362/132, 133, 155, 374, 375, 287, 427
See application file for complete search history.

(56) References Cited

U.S. PATENT DOCUMENTS 2,644,882 A * 7/1953 Voda ..... 362/94

(Continued)

FOREIGN PATENT DOCUMENTS

DE 202004011636 U1 9/2004

(Continued)

*Primary Examiner*—Stephen F Husar
*Assistant Examiner*—James W Cranson
(74) *Attorney, Agent, or Firm*—Norris McLaughlin & Marcus, PA

(57) ABSTRACT

Illumination device (20) for box-like or chest-like items of furniture having a body, which is provided with at least one door or flap, which can be pivoted between a closed position and an open position in relation to the body or a withdrawable part, for example a drawer or the like, which can be displaced between a closed position in which it is pushed into the body and an open position in which it is withdrawn from the body. The illumination device (20) has a holder, which can be connected to an electrical current source, for an illumination means (40), wherein a switch, which interrupts or opens the electrical connection in the event of a predetermined position of the door or flap or withdrawable part in relation to the body, is provided in the electrical connection between the current source and the illuminations means. The holder for the illumination means (40) has an adapter (32) having an adapter housing (34) which can be mounted in the body and in which a spring-prestressed pressure piece (36), which can be displaced between two separate positions and is in direct or indirect operative connection with the switch, is arranged. The adapter housing (34) is provided on one of the furniture fittings holding the door or flap or the withdrawable part movably on or in the body.

11 Claims, 4 Drawing Sheets

U.S. PATENT DOCUMENTS

| | | | | |
|---|---|---|---|---|
| 2,686,252 | A * | 8/1954 | Geraci | 362/145 |
| 4,442,478 | A | 4/1984 | Stansbury | |
| 5,032,957 | A | 7/1991 | Canfield | |
| 2002/0145868 | A1 | 10/2002 | Barton | |

FOREIGN PATENT DOCUMENTS

| | | | |
|---|---|---|---|
| EP | 1260158 | A2 | 11/2002 |

* cited by examiner

ILLUMINATION DEVICE FOR ITEMS OF FURNITURE

This application is a 371 application of PCT/EP2006/064122 filed Oct. 14, 2006, which claims priority to the German application DE 20 2005 016 829.7 filed Oct. 27, 2005.

The invention relates to an illumination device for box-like or chest-like items of furniture with a carcass which is provided with at least one door or flap which can be pivoted between a closed position and an open position relative to the carcass and/or a pull-out device, for example a drawer or the like, which can be displaced between a closed position in which it is pushed into the carcass and an open position in which it is withdrawn from the carcass, the illumination device having a mounting which can be connected to an electrical current source for an illumination means, wherein a switch which interrupts or opens the electrical connection at a predetermined position of the door or flap or displaced position of the pull-out device relative to the carcass is provided in the electrical connection between the current source and the illuminations means, wherein the mounting for the illumination means has an adapter with an adapter housing which can be mounted in the carcass and in which is disposed a spring-biased thrust piece which can be displaced between two positions spaced from one another and which is in direct or indirect operative connection with the switch.

Cupboards, and in particular large walk-in built-in cupboards, are frequently provided with an addition illumination device which is switched on by the user as the cupboard doors are opened, in order to identify the contents of the cupboard better and thereby to facilitate rapid access to the desired garment or the desired article which may be contained in a drawer additionally installed in the interior of the cupboard. As a rule refrigerators are also provided with an illumination in the form of a miniature filament bulb which is screwed into a lamp socket in the thermostat setting housing integrated in the housing and is automatically switched on when the refrigerator door is opened and is automatically switched off when it is closed. In each case the illumination means are disposed in separate sockets of lights which project into the interior of the cupboard carcass and thereby may give rise to catching and possible damage to the light or to the illuminations provided in the light.

By contrast the object of the invention is to create an illumination device for items of furniture which can be mounted in a space-saving manner in the interior of the items of furniture, wherein it should basically be possible to combine the device with furniture fittings which are in any case present.

Starting from an illumination device of the type referred to in the introduction this object is achieved in that the adapter housing of the illumination device is provided on one of the furniture fittings which holds the door or flap or the pull-out device so that it is movable on or in the carcass.

In this case the adapter housing can be constructed as an integral part of one of the components of the associated furniture fitting or—alternatively—as a separate component which can be mounted on and removed from one of the components of the appertaining furniture fittings.

The adapter is then provided on a door mounting part of a furniture hinge which is constructed as a hinge cup which can be fitted countersunk in a recess in the door or the flap.

Alternatively it is possible to dispose the adapter on the carcass mounting part of the furniture hinge which is constructed as an elongate bracket.

In this case the illumination means is advantageously disposed in the free end of the thrust piece projecting from the adapter housing, wherein the free end region of the thrust piece is then of transparent or translucent construction at least in its end region projecting from the adapter housing, which is achieved for example by producing it from a clear or light-permeable plastics material at least in the transparent or translucent region. As an alternative to the arrangement on or in the thrust piece the illumination means can also be provided on or in the adapter housing.

The illumination means can then be formed by a lamp in the form of a miniature filament bulb of small external dimensions which radiates light when it is electrically conductively connected to the current source, such as is used for example in pocket lamps or torches.

It is particularly advantageous if the illumination means is formed by at least one light-emitting diode (LED) which emits light when it is electrically conductively connected to the current source. Such diodes, which for some time have also been available with neutral-colour white light radiation, have in addition to the advantage of small external dimensions by comparison with electric light bulbs the advantage of increased light yield with reduced current consumption, so that instead of mains current as electrical current source it is also possible to use miniature batteries, such as button cells or also appropriately miniaturised rechargeable batteries.

The light-emitting diode advantageously provided in a socket which forms part of the thrust piece and is retained so as to be longitudinally movable in the adapter housing. On its end pointing out of the adapter housing an opening is provided for the light generated by the light-emitting diode to exit, wherein in the said opening there is advantageously provided an optical element, for example in the form of a lens, by which the light generated by the light-emitting diode is radiated in a predetermined distribution characteristic.

Adjoining the end of the socket directed into the interior of the adapter housing at least one battery or rechargeable battery with small external dimensions can then—as mentioned—be provided as electrical current source.

The invention is explained in greater detail in the following description in conjunction with three embodiments, and in the drawings.

Figure 1:
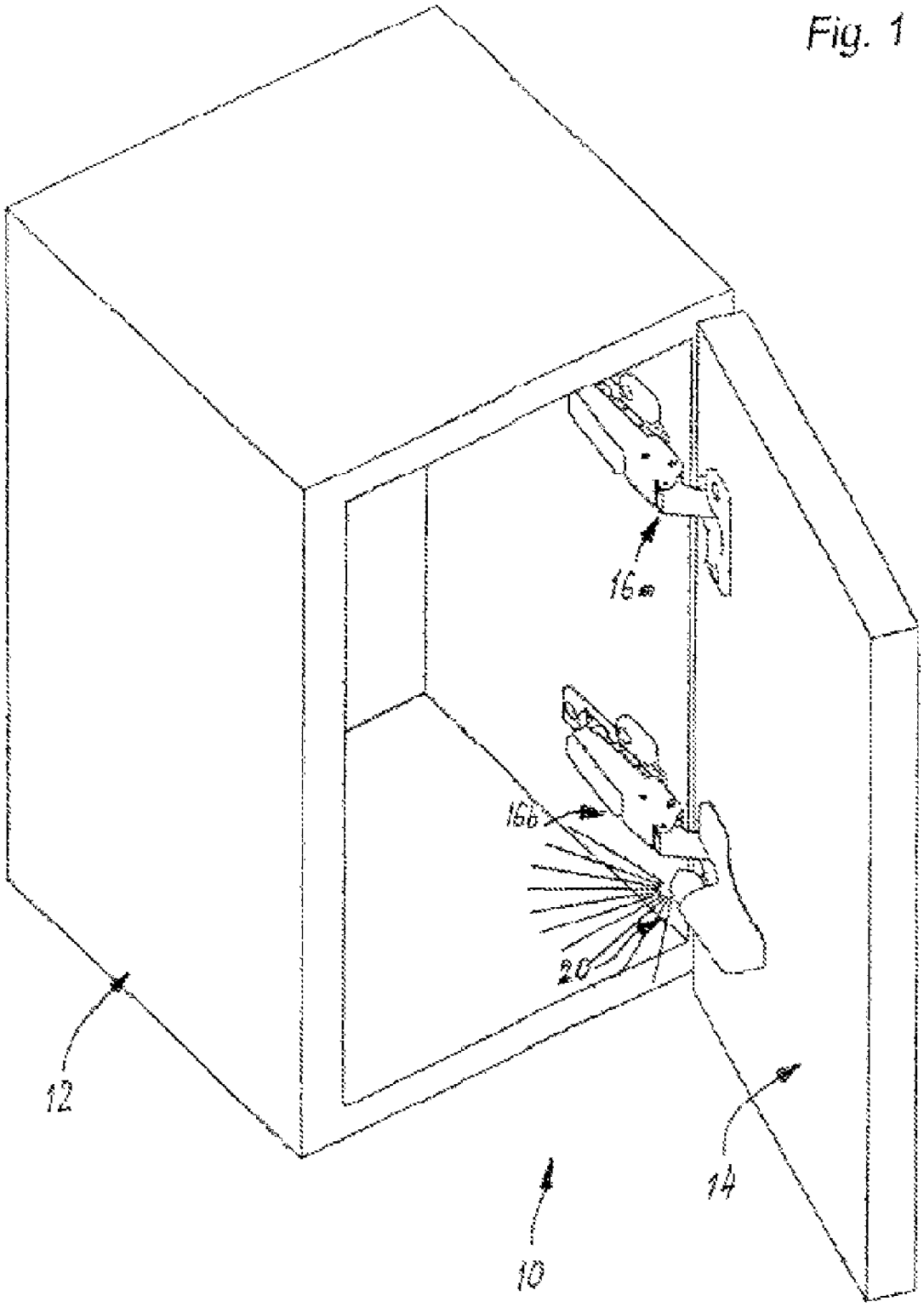
FIG. 1 shows an isometric representation of a cupboard with a door pivotably articulated on the carcass by means of two four-bar hinges, of which in the door mounting part of the hinge shown at the bottom of the drawing an illumination device is provided which radiates light into the interior of the carcass when the door leaf is open.

In FIG. 1 an item of furniture is illustrated in the form of a simple cupboard 10, the box-like carcass 12 of which has an open front face which facilitates access into the interior of the carcass and which can be closed by a door leaf 14 pivotably articulated on a vertical carcass wall 12*a*. The pivotable articulation of the door leaf 14 on the cupboard carcass 12 takes place by means of two hinges which are offset in height and in the special case are constructed as four-bar hinges 16*a*, 16*b*, of which the lower hinge 16*b* in FIG. 1 is illustrated separately in FIGS. 2 and 3. The basic construction of the hinges 16*a* and 16*b* is the same, only the hinge 16*b* being additionally provided with an illumination device 20.

The hinges 16*b* and 16*a* are constructed as four-bar hinges in which a carcass mounting part, which is constructed as an elongate bracket 24 and is capable of being latched on a mounting plate 22 already mounted on the carcass wall 12*a*, is coupled to a door mounting part, which is constructed as a hinge cup 26 which can be fitted countersunk in a recess in the door leaf 14, by way of a four-bar mechanism formed by two hinge linking elements 28, 30 which in their end regions are each mounted pivotably on the bracket or in the hinge cup. In this respect the hinges 16*a* and 16*b* have—as mentioned—the same construction. In the case of the hinge 16*b* the hinge cup 26 is additionally provided with the aforementioned illumination device 20, for which the hinge cup is additionally provided with an adapter 32 which has an elongate adapter housing 34 which is either integrally connected to the hinge cup 26 or is separately produced and can be fixed on the upper face of the hinge cup. An elongate thrust piece 36 is mounted so as to be longitudinally displaceable in the adapter housing, the end of the thrust piece closest to the hinge cup being biased by a spring 38 under compression tension through an end position in which this end which is exposed—when the door leaf is open (FIG. 1)—comes to rest on the bracket 24 during closing of the door leaf 14 and then as closing proceeds it is forced into a position in which it is pushed back into the adapter housing 34.

Figure 3:
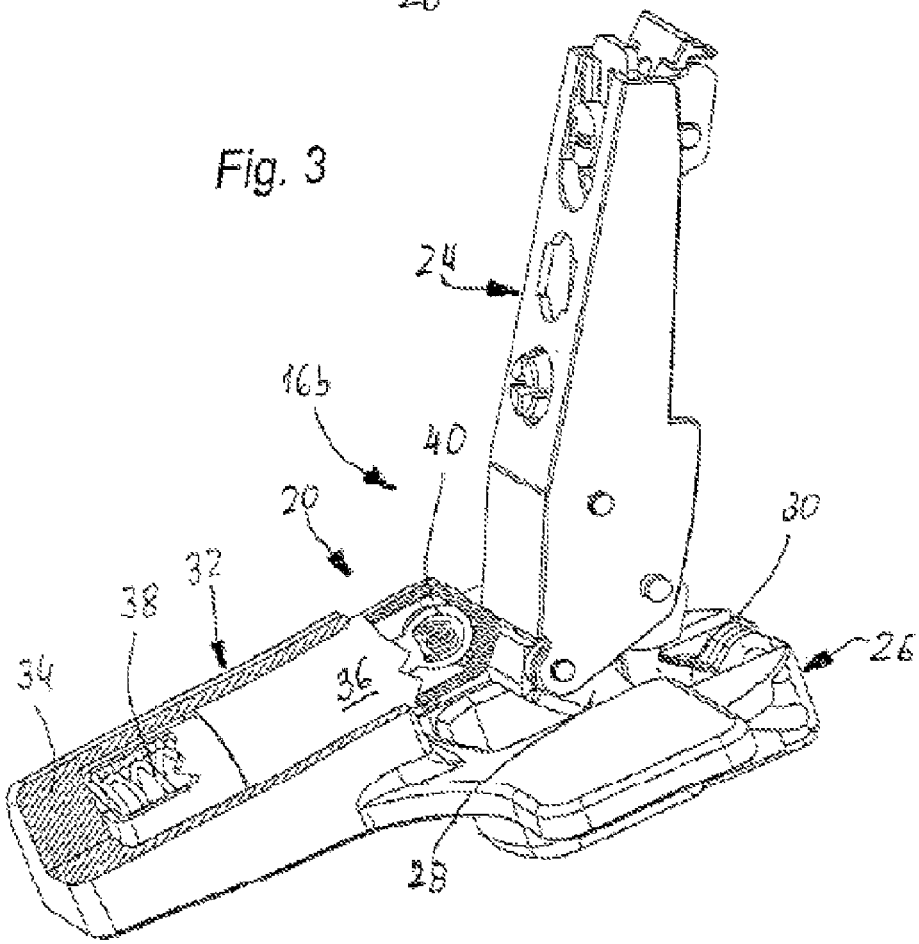
FIG. 3 shows the hinge shown in FIG. 2 in an isometric representation, wherein the adapter provided with the illumination device and associated with the hinge cup is partially cut away or broken away in the region of the thrust piece.

With regard to the configuration possibilities and the way in which the adapter 32 of the illumination device is disposed on the hinge cup 26 reference should be made here to WO 03/004817 A1 (FIGS. 11 and 12) with regard to integration of the adapter housing 34 into the hinge cup 26 and to WO 2005/088052 A1 with regard to the construction of the adapter as a separate component which can be mounted on and removed from the hinge cup 26. The said publications do not relate to illumination devices but to damping devices for hinges, although in this special case the damper housing with the longitudinally displaceable actuating element are so similar in shape and size to the adapter housing and thrust piece that the reference to these publications renders unnecessary a detailed representation and description of the adapter 32 and its arrangement on the hinge cup 26. In the special case the said external similarities are also completely desirable, since in this way it is possible to assign different additional functions to a set of related hinges—in this case for example the hinges 16*a* and 16*b*—with the same appearance. In the present case a damping device according to the aforementioned second publication could for example be additionally associated with the hinge cup 26 of the hinge 16*a*, whereby the two hinges 16*a* and 16*b* are visually practically indistinguishable.

the illumination means 40 of the illumination device 20 is illustrated schematically in FIG. 3 as a miniature filament bulb disposed in the interior of the thrust piece 30 in the end thereof projecting out of the adapter housing 34. This arrangement of the lamp 40 which is protected in the thrust piece then naturally presupposes that the thrust piece 36 is made at least in its end region projecting from the adapter housing 34 from a transparent, i.e. clear material or a largely translucent, i.e. light-permeable material. Therefore a possible solution is to produce the thrust piece overall from a plastics material with the required optical properties and additionally sufficient strength and abrasion resistance.

Instead of the miniature filament bulb 40 it is also possible to use another suitable radiation source, for example a light-emitting diode (LED) as the illumination means. Such diodes, which have also been available for some considerable time in a neutral white light, have the advantage that with relatively low current consumption they produce a high light yield and only radiate a small amount of heat. Therefore when such diodes are used it is conceivable to use miniaturised batteries, such as for example button cells or the like or rechargeable batteries, which can be disposed in a receptacle—not shown—in the adapter housing. On the other hand, when miniature filament bulbs are used a supply of current from the electrical mains power network may preferably be considered by way of a power pack which transforms the mains voltage down to the necessary lower voltage.

Since the illumination unit should then only radiate light if access is gained to the interior of the carcass, i.e. the door leaf 14 is opened, a switching device must be provided which interrupts the electrical connection between the current source and the illumination means 40 with the door leaf 14 closed and only produces the electrical connection when the door leaf is opened. This switching device (not shown in the drawings) can be formed for example by a pair of contacts which is electrically connected to the illumination means 40 in the outer surface of the thrust piece 36 in the region thereof lying in the adapter housing, and with which a pair of contacts connected to the electrical power source is associated, wherein the arrangement of the pairs of contacts is such that the switching on or off of the illumination means takes place in the desired manner by the displacement of the thrust piece 26 as the door leaf 14 closes.

Figure 2:
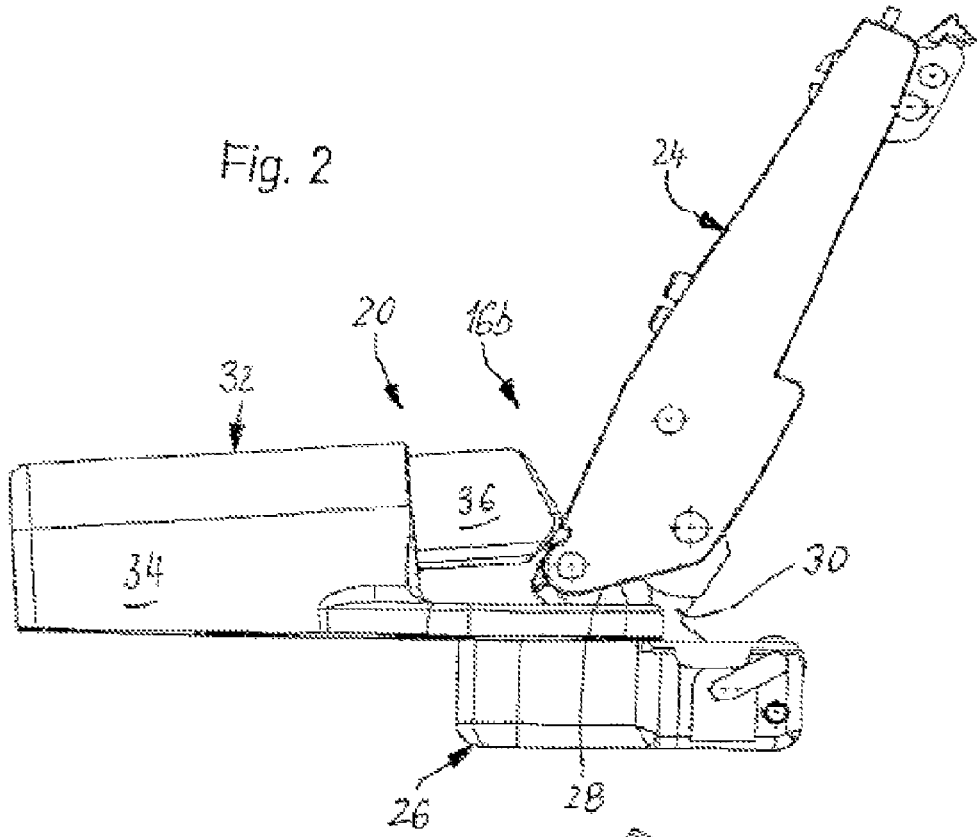
FIG. 2 shows a side view of the hinge shown in FIG. 1 provided with the illumination device.
Figure 4:
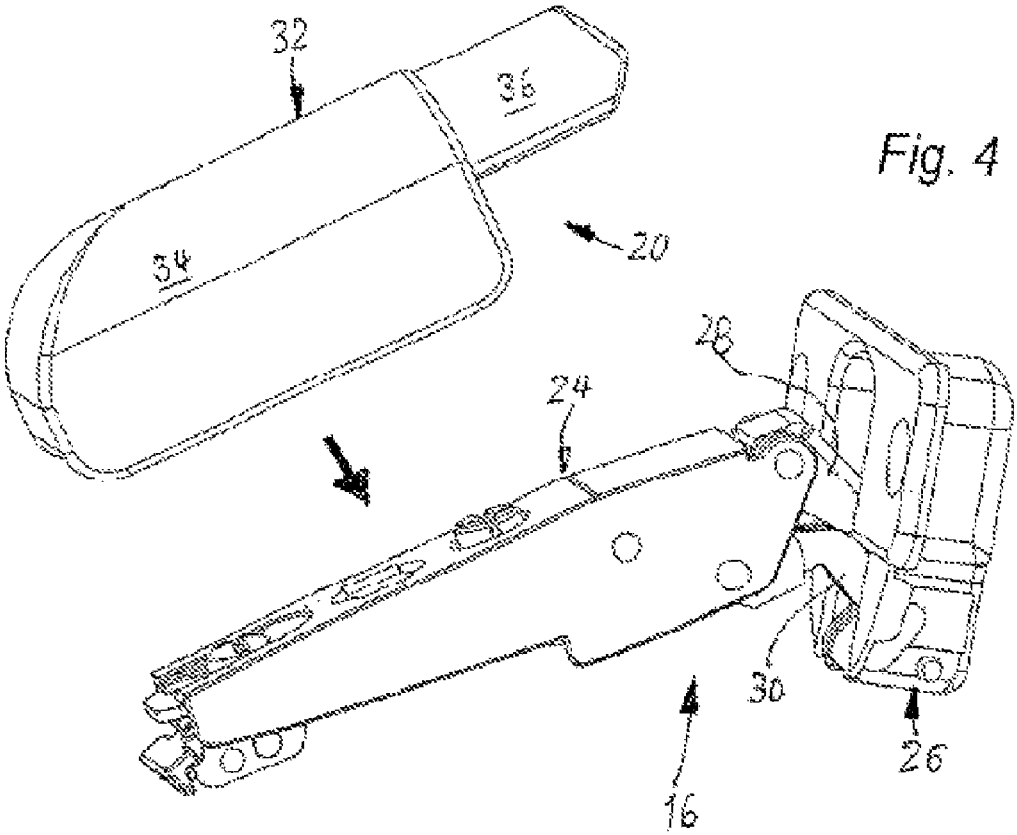
FIG. 4 shows a furniture which corresponds functionally to the hinge according to FIGS. 2 and 3, in which the separately produced adapter of the illumination device is provided for mounting on the carcass mounting part constructed as a bracket, the adapter being shown with the thrust piece in a position above the bracket nut not yet mounted on the bracket.
Figure 5:
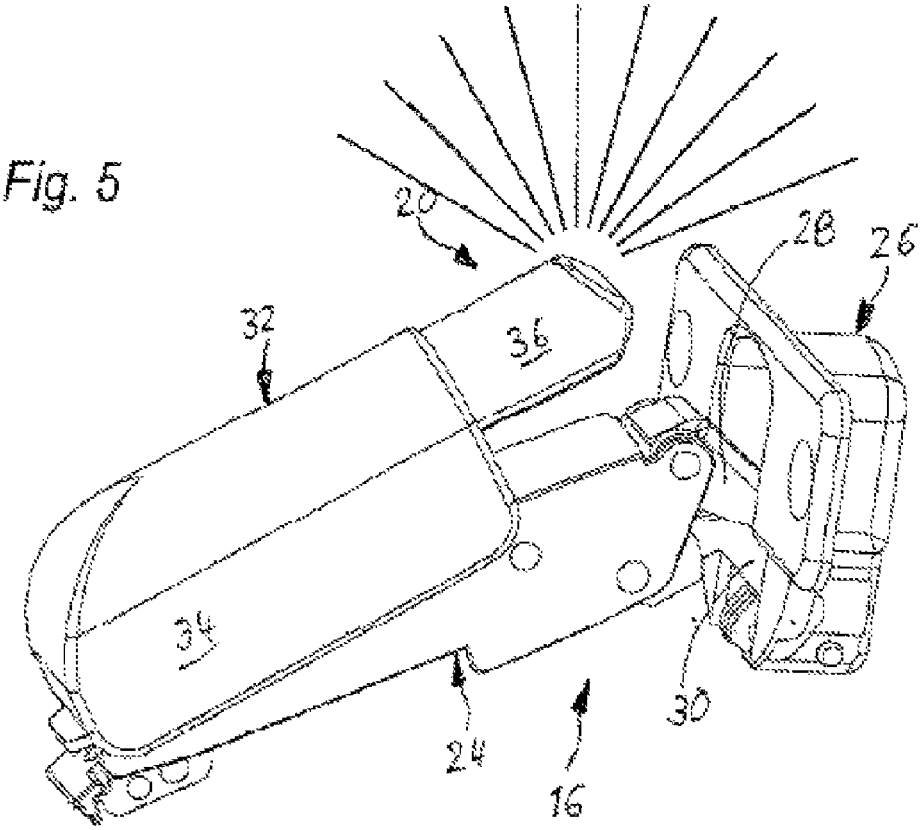
FIG. 5 shows the furniture hinge shown in FIG. 4 with the adapter fitted.

An arrangement of the illumination device 20 on a hinge 16 is shown in FIGS. 4 and 5, in which the adapter housing 34 of the adapter 32 produced as a separate component is disposed on the bracket 24—different from the arrangement described in connection with FIGS. 2 and 3. In this case the elongate adapter housing 34 is designed in such a way that from the upper face it can be pushed over the bracket and can then be latched in the correct mounting position on the bracket 24. The means which facilitate this latching are not illustrated in the drawings, but here too reference may be made to damper housings of damper devices which can be latched on the bracket of hinges and are known from the prior art.

Moreover, since both the hinge 16 and also the illumination device 20 corresponding to the embodiment described in connection with FIGS. 2 and 3, it is sufficient here to refer to the preceding description since the same reference numerals are assigned to the same parts of the two embodiments in the drawings.

A modification of the hinge 16*b* which is described in connection with FIGS. 2 and 3 and provided according to the invention with an illumination device and in which the illumination means provided in the illumination device 20 is formed by a light-emitting diode 40' which radiates a white light—instead of the miniature filament bulb 40 provided in the embodiment according to FIGS. 2 and 3. The light-emitting diode 40' is retained so as to be displaceable by a predetermined amount in a tubular socket 44, wherein in the direction of radiation a lens 46 is inserted in a portion of the socket 44 which has an enlarged diameter, the lens not only protecting the light-emitting diode against mechanical damage but also serving as an optical system, which focuses the light radiated by the light-emitting diode and directs the light into the interior of the carcass of a cupboard which is to be illuminated, the door leaf of which is pivotably articulated on the carcass by at least one hinge 16*b*.

Figure 6:
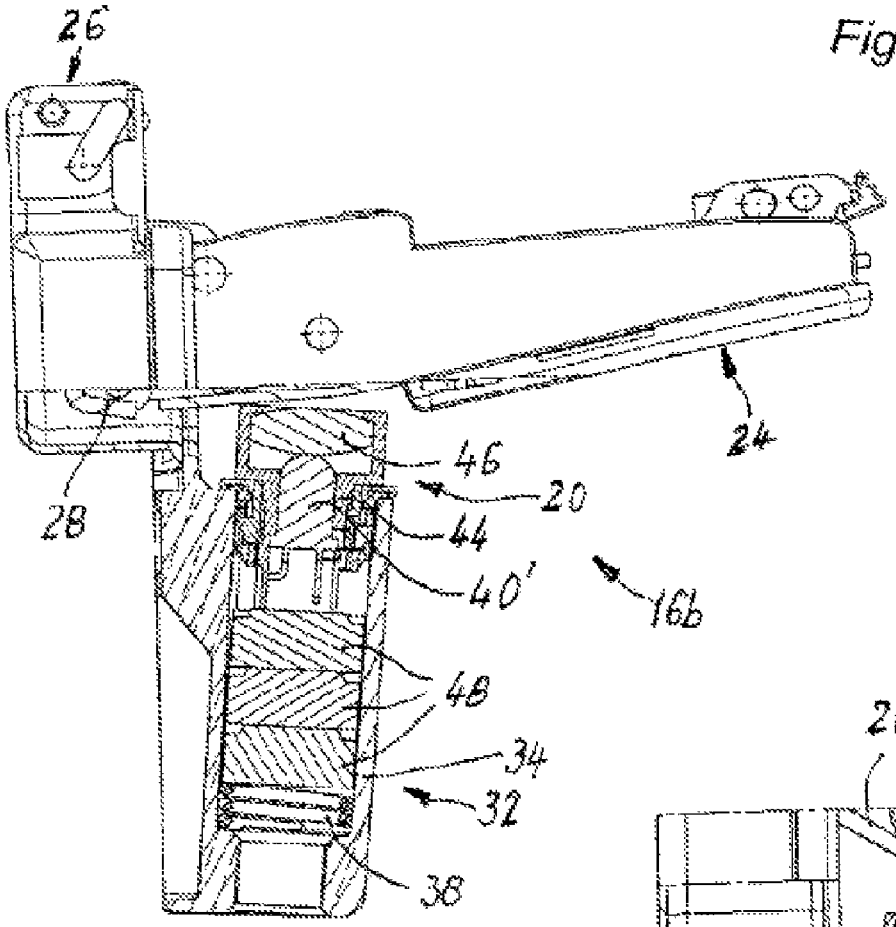
FIG. 6 shows a partially cut-away side view of a hinge which is a modification of the hinge shown in FIGS. 2 and 3 and in which the illumination device is also provided on the hinge cup, in the hinge closure position.
Figure 7:
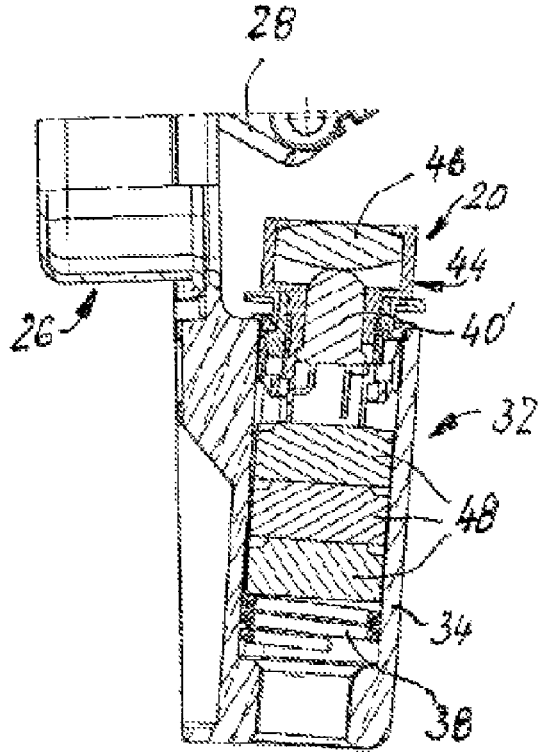
FIG. 7 shows the hinge shown in FIG. 6 in the open position, in which parts of the hinge cup and of the hinge bracket are broken away.

In the interior of the adapter housing 34 the socket 44 is supported on a stack of three button cells 48 which are forced against the socket by a biased spring 38 supported on the underside of the lowest button cell lying opposite the light-emitting diode, so that the socket is biased into the position shown in FIG. 7 in which it projects out of the adapter housing. During closing of the door leaf articulated by the hinge 16*b* on the carcass, just before reaching the closed position the socket 44 comes to rest on the upper web surface of the bracket 24 and is then forced—against the bias of the spring 38—into the position illustrated in FIG. 6 in which it is pushed back into the adapter housing 34. Thus the socket 44 which is closed off by the lens 46 together with the light-emitting diode 40' and the stack of button cells 48 pressed against the socket by the spring 38 constitute a functional equivalent to the thrust piece 36 of the embodiment according to FIGS. 2 and 3.

Thus the extent of the displacement of the socket 44 in the adapter housing 34 is available as switching path for the actuation of the switch—not shown—which switches off the light-emitting diode in the closed position.

It can be seen that within the scope of the idea underlying the invention modifications and variants of the embodiments described above are possible. Thus the adapter can also be disposed on one of the pull-out rails, and preferably one of the guide rails of drawer pull-out guides, so that the illumination device can then be used for illumination of the interior of drawers which are completely or partially pulled out of the carcass.

The invention claimed is:

1. An illumination device for a box-like or chest-like item of furniture, wherein the item has a hinge and a carcass with at least a door or flap or a pull-out device, wherein the door or flap is configured to pivot between a closed position and an open position relative to the carcass via the hinge, wherein the pull-out device is configured to be displaced, via the hinge, between a closed position in whereby the pull-out device is pushed into the carcass and an open position whereby the pull-out device is withdrawn from the carcass, the illumination device comprises:

a mounting connected to an electrical current source for an illumination means, a switch provided in an electrical connection between the electrical current source and the illumination means, wherein the switch is configured to interrupt or open the electrical connection at a predetermined pivoted position of the door or flap or at a displaced position of the pull-out device with respect to the carcass;

an adapter associated with the illumination means, wherein the adapter has an adapter housing configured to be mounted in the carcass; and a spring-biased thrust piece disposed within the adapter housing, wherein the spring-biased thrust piece is configured to be displaced between two positions spaced from one another, wherein the spring-biased thrust piece is in direct or indirect operative connection with the switch, wherein the adapter housing is provided on the hinge such that the adapter housing is movable with respect to carcass and is an integral part of a component of the hinge, and wherein the adapter is provided on a door mounting part of the hinge, wherein the door mounting part of the hinge is a hinge cup countersunk in a recess in the door or the flap.

2. The illumination device according to claim 1, wherein the illumination means is disposed in a free end of a thrust piece projecting from the adapter housing.

3. The illumination device according to claim 2, wherein the thrust piece is of transparent or translucent construction at least in the free end region projecting from the adapter housing.

4. The illumination device according to claim 3, wherein the thrust piece is produced from a clear or light-permeable plastics material at least in the transparent or translucent region thereof.

5. The illumination device according to claim 2, wherein the illumination means is disposed in a socket of the thrust piece and is retained so as to be longitudinally movable in the adapter housing.

6. The illumination device according to claim 5, wherein the socket has an opening on an end pointing out of the adapter housing, wherein an optical element is provided in the opening of the socket, wherein the optical element is adapted to generate light radiated by the illumination means in a predetermined distribution characteristic.

7. The illumination device according to claim 5, wherein the electrical current source comprises at least one battery (48) or rechargeable battery of miniaturized construction.

8. The illumination device according to claim 1, wherein the illumination means is provided on or in the adapter housing.

9. The illumination device according claim 1, wherein the illumination means is a lamp adapted to radiate light when the illumination means it-is electrically conductively connected to the electrical current source.

10. The illumination device according to claim 1, wherein the illumination means is at least one light-emitting diode adapted to emit light when the illumination means is electrically conductively connected to the electrical current source.

11. An illumination device for a box-like or chest-like item of furniture , wherein the item has a hinge and a carcass with at least a door or flap or a pull-out device, wherein the door or flap is configured to pivot between a closed position and an open position relative to the carcass via the hinge, wherein the pull-out device is configured to be displaced, via the hinge, between a closed position in whereby the pull-out device is pushed into the carcass and an open position whereby the pull-out device is withdrawn from the carcass, the illumination device comprises:

a mounting connected to an electrical current source for an illumination means, a switch provided in an electrical connection between the electrical current source and the illumination means, wherein the switch is configured to interrupt or open the electrical connection at a predetermined pivoted position of the door or flap or at a displaced position of the pull-out device with respect to the carcass;

an adapter associated with the illumination means, wherein the adapter has an adapter housing configured to be mounted in the carcass ; and a spring-biased thrust piece disposed within the adapter housing, wherein the spring-biased thrust piece is configured to be displaced between two positions spaced from one another, wherein the spring-biased thrust piece is in direct or indirect operative connection with the switch, wherein the adapter housing is provided on the hinge such that the adapter housing is movable with respect to the carcass, wherein the adapter housing is a separate component that is configured to be mounted on and removable from a component of the hinge, and wherein the adapter is provided on a carcass mounting part of the hinge, wherein carcass mounting part of the hinge is an elongate bracket.

* * * * *